United States Patent [19]

Jameson

[11] 4,213,853

[45] Jul. 22, 1980

[54] FROTH FLOTATION

[75] Inventor: M. Phillip Jameson, Somerville, N.J.

[73] Assignee: Engelhard Minerals & Chemicals Corporation, Menlo Park, N.J.

[21] Appl. No.: 872,332

[22] Filed: Jan. 25, 1978

[51] Int. Cl.[2] ..... B03D 1/02

[52] U.S. Cl. ..... 209/166

[58] Field of Search ..... 209/166, 167; 560/151; 252/61, 312; 8/70

[56] References Cited

U.S. PATENT DOCUMENTS

| | | | |
|---|---|---|---|
| 1,492,904 | 5/1924 | Sulman | 209/166 |
| 1,972,588 | 9/1934 | Hansen | 209/166 |
| 1,986,817 | 1/1935 | Hasselstrom | 252/61 |
| 2,202,601 | 5/1940 | Ried | 209/166 |
| 2,438,092 | 3/1948 | Lynch | 560/151 |
| 2,597,281 | 5/1952 | Borstelmann | 8/70 |
| 3,047,353 | 7/1962 | Klein | 252/312 X |
| 3,314,537 | 4/1967 | Greene | 209/166 X |
| 3,337,048 | 8/1967 | Mercade | 209/166 X |
| 3,469,693 | 9/1969 | Arbiter | 209/166 |
| 3,482,013 | 12/1969 | Mercade | 209/166 X |
| 3,635,337 | 1/1972 | Mercade | 209/166 X |
| 3,830,366 | 8/1974 | Day | 209/166 |
| 3,915,391 | 10/1975 | Mercade | 209/166 X |
| 3,929,629 | 12/1975 | Griffith | 209/167 |

FOREIGN PATENT DOCUMENTS

| | | | |
|---|---|---|---|
| 122177 | 9/1946 | Australia | 209/166 |
| 168927 | 9/1921 | United Kingdom | 209/166 |
| 538530 | 8/1941 | United Kingdom | 209/166 |
| 584206 | 1/1947 | United Kingdom | 209/166 |

OTHER PUBLICATIONS

Chem. Abst., 73, 1970, 101144n.
Chem. Abst., 82, 1975, 33609b.
Chem. Abst., 75, 1971, 39080z

*Primary Examiner*—Robert Halper
*Attorney, Agent, or Firm*—Inez L. Moselle

[57] ABSTRACT

A reagent schedule useful for the froth flotation of undeslimed cassiterite ore pulps comprises a metal salt-/silicate hydrosol dispersant/depressant and a N-alkyl sulfosuccinamate collector, the sulfosuccinamate preferably being emulsified with a heavy neutral petroleum hydrocarbon oil such as mineral oil. In flotation of cassiterite from an undeslimed ore pulp, the collector is used along with a metal salt/silicate hydrosol dispersant/depressant at a pH in the range of about 4 to 7.

11 Claims, No Drawings

FROTH FLOTATION

BACKGROUND OF THE INVENTION

1. Field of the Invention

This invention deals with the recovery of tin oxide minerals (cassiterite) from ores, ore concentrates and preconcentrates by a simple and economically feasible froth flotation method. The invention is concerned especially with the flotation separation of tin values from gangue minerals in low grade slime-containing ore pulps by a procedure that obviates the need to deslime the ore pulp before attempting to recover the tin by flotation. The invention also relates to a novel slime and gangue dispersant and depressant and a novel collector combination especially useful in the flotation beneficiation of undeslimed cassiterite ore pulps.

2. Prior Art

The prior art is replete with proposed solutions to the problem of recovering cassiterite from ore, ore concentrates and preconcentrates by froth flotation. A wide variety of collectors has been advocated and considerable research has been expended in optimizing the parameters of various flotation systems. For the most part the flotation processes are limited in effectiveness to the beneficiation of deslimed ore pulps, especially so when the tin grades are low. One class of collectors that has been advocated is the sulfosuccinamates optionally used with fuel oil to control froth. Flotation is carried out at a pH below 5. Reference is made to U.S. Pat. No. 3,469,693 to N. Arbiter. Those knowledgeable in commercial flotation practice are well aware that desliming, necessarily followed by a considerable loss of tin in rejected slimes, is essential for successful use of the sulfosuccinamate reagent when it is used in accordance with the teachings of the prior art.

Attempts have also been made to float tin from low grade slime-containing pulps without desliming using fatty acid-type collectors. However, the flotation schemes recommended were generally very complex, involved a costly reagent schedule, and could not be used in commercial flotation practice.

THE INVENTION

A relatively simple economical froth flotation procedure has now been invented which solves the problem of beneficiating cassiterite from primary ore deposits and/or tailings from deposits found in Bolivia and elsewhere in the world. This novel froth flotation procedure is useful in treating slime-containing ore pulps and is applicable to the processing of low grade finely mineralized ores or ore concentrates or preconcentrates, particularly those containing very finely ground minerals. In fact, the froth flotation process of the invention may be employed with excellent results on finely mineralized feed containing appreciably less than 1% Sn. Indeed concentrates containing well above 10% Sn can be achieved at exceptionally high overall recoveries.

One aspect of the instant invention resides in use as the collector of a N-alkyl sulfosuccinamate wherein the alkyl group contains 12 to 22 carbon atoms. The collector reagent is preferably an emulsion in water of a neutral petroleum hydrocarbon oil and the N-alkyl sulfosuccinamate.

The other aspect of the invention comprises a simple process for floating tin (cassiterite) from gangue in a slime-containing ore pulp without desliming the pulp. The essence of the process resides in using a metal salt/silicate hydrosol. The latter is used to disperse the pulp, and to prevent the contact of the gangue and slime particles with collectors while carrying out the flotation in a mildly acidic pulp, at a pH in the range of 4 to 7, preferably at a pH in the range of 4 to 5. The latter pH range represents a departure from the pH ranges previously used with the hydrosols in various ore flotation schemes.

Another unique and, from a practical point of view, very important feature of the hydrosol when used for cassiterite flotation from slime-containing tin ore, ore concentrate or preconcentrate pulps is that in addition to the suppression of gangue and slime particles, the hydrosol favorably regulates the flotation froth characteristics. The presence of the hydrosol in the pH range from about 4 to about 7 causes the froth to become low, lacy and brittle even when a sulfosuccinamate collector alone is used. The latter hydrosol action is highly desirable and such froth quality is not known in other flotation systems which, by the virtue of a sulfosuccinamate presence, often exhibit uncontrollable voluminous and tough types of froth if the desliming, causing necessarily significant tin value losses in slimes, is not carried out very thoroughly.

As mentioned, a feature of a preferred embodiment of the invention resides in use of the sulfosuccinamate in the form of an emulsion which also contains a relatively heavy neutral hydrocarbon oil exemplified by mineral oil. Contrary to the prior art teaching of the efficacy of fuel oil with a sulfosuccinamate in tin flotation, it has been found that substitution of fuel oil for mineral oil in the emulsion will not produce beneficial results on tin recovery in the given system such as those that can be achieved by employing mineral oil. In some cases, substitution of fuel oil will actually decrease grade and/or recovery.

DESCRIPTION OF PREFERRED EMBODIMENTS

An essential feature of the invention is the use of the hydrosol, i.e., metal salt/silicate combination which very effectively disperses flotation pulp and depresses gangue and slime particles by a mechanism which prevents or blocks collector contact with the aforementioned particle surfaces, thus obviating the need to deslime the slime-containing ore, ore concentrate or preconcentrate pulps.

The hydrosols used in practice of the invention are produced by mixing dilute aqueous solutions of metal salts; for example, salts of aluminum, calcium, iron, zinc or magnesium, with dilute aqueous solutions of alkaline silicates such as sodium silicate. A presently preferred metal salt is aluminum sulfate. A typical preferred hydrosol contains from about 0.1 to 1 weight percent aluminum sulfate (anhydrous basis) and about 1 to 10 weight percent alkaline sodium silicate (anhydrous basis). The hydrosols are distinctly alkaline, generally having pH values in the range of 9 to 11. Sufficient hydrsol is used to maintain the pulp in a dispersed condition. This will vary inter alia with the nature of the solids in the pulp, with the pH and with the ionic constituents of the pulp water. Generally sufficient hydrosol is used to provide about 0.1 to 2 pounds per ton metal salt and from 1 to 20 pounds per ton sodium silicate.

The process of the invention is useful in beneficiating pulps containing primary slimes, secondary slimes or both. In practicing the invention, the flotation feed may be reduced to a required mineral liberation size by any convenient size reduction technique, preferably by using conventional wet grinding techniques. In some cases a grind of 400 mesh may be necessary. However, the process of the invention is uniquely suited to the beneficiation of heavily slimed feed and it will not be necessary to deslime the ore pulp when such a fine grind is made if the above-described hydrosols are used. In fact, feed containing an appreciable content of particles 10 microns or finer may be used. Thus, slime tailings from gravity concentrators or flotation plants may be employed as flotation feed. The term "slime" as used herein refers to particles finer than 10 microns, equivalent spherical diameter.

The N-alkyl sulfosuccinamates useful in practice of the invention include those sulfo compounds in which the N-alkyl group has a long chain, for example compounds in which the alkyl group has the formula $C_nH_{n2+1}$ in which n is an integer from 12 to 22. Examples of such compounds are mono-N-octadecyl sulfosuccinamates such as N-octadecyl tetrasodium 1,2 dicarboxyethyl sulfosuccinamate.

The sulfosuccinamate may be formed into an aqueous emulsion along with a heavy neutral hydrocarbon oil such as mineral oil by agitating the sulfosuccinamate and oil in water, preferably using a high shear mixer. Recommended is the use of commercial sulfosuccinamate such as Procol CA540, approximately 35 percent solids, and oil in relative proportions of about 1:4 to 4:1 on a weight basis. Excellent results were achieved using approximately equal weights of the commercial sulfosuccinamate and oil. Dilute emulsions are recommended; for example emulsions containing from 0.25 to 5% by weight of the mixture of oil and the sulfosuccinamate. Especially recommended are emulsions containing about 0.5 to 1% weight of the mixture. Emulsion stabilizers, known in the art, may be used but usually they will not be necessary when sufficient shear has been used to emulsify the components of the collector. Generally sufficient emulsion is used to provide from 0.05 to 1, preferably 0.1 to 0.5 pounds per ton of both the sulfosuccinamate and the oil.

When the ore contains appreciable sulfide minerals, they can be removed from the pulp by any suitable means of concentration including bulk or differential sulfide flotation carried out before preparing the feed for tin flotation.

It is possible to carry out sulfide flotation using a dispersed pulp, possibly using hydrosol for this purpose, in which case the sulfide tailings may be adequately dispersed for tin flotation. At any rate, the hydrosol is preferably mixed into the tin ore pulp before addition of the collector although in some cases it may be feasible to add the collector first and then incorporate all or a portion of the hydrosol. In addition to the roughing stage, the hydrosol may be added to various cleaner flotation stages if required.

It is preferable to agitate (condition) the pulp with the collector for a relatively long time, for example 5 to 30 minutes, using high speed agitation. After conditioning the pH of the pulp should be adjusted to a value within the range of about 4 to 7 before attempting to float the cassiterite. Any acid including sulfuric acid is suitable for downward adjustment of pH; any base including soda ash, ammonium hydroxide or sodium hydroxide is recommended for upward adjustment. In some instances it may be advantageous to adjust pH to the desired value in the range of 4 to 7 before adding the collector.

In most systems the collector will provide adequate and desirable frothing without need to add conventional frothers such as pine oil or an alcohol. The rougher tin float is usually cleaned one or more times by reflotation with stagewise addition of collector if necessary. Sulfosuccinamate incorporated during cleaner flotation may be added with or without prior emulsification. Middlings are usually recirculated.

In an illustrative test, low grade, finely mineralized tin ores (0.7% to 1% Sn grade) were processed to recover cassiterite. In addition to zinc sulfide (10 to 20% Zn), these ores also contained small amounts of lead and silver (1 to 2% Pb and 5 to 15 ounces per ton Ag) and pyrite. The ores were ground to 200 mesh and subjected to sulfide flotation. The final sulfide tailings (which may or may not be dewatered prior to tin flotation) were formed into well-dispersed mildly alkaline pulps by addition of hydrosol and were processed to float cassiterite from silicate and other gangue without a desliming step in accordance with this invention.

In one test, the sulfide tailings contained 1.2% Sn and some residual pyrite not removed during sulfide flotation was subjected to a pyrite scavenger flotation before floating the tin from gangue by the process of this invention. The sulfide tailings had a pH of 4.0 and were at about 10% solids.

To prepare the sulfide tails for the initial pyrite scavenger flotation and subsequent tin flotation, soda ash was added (1.2 pounds per ton) to bring pH to 6.0. The pulp was then dispersed by conditioning the tailings for one minute with a 1% alum sulfate-sodium silicate hydrosol in amount sufficient to incorporate 0.8 pounds per ton $Al(SO_4)_3.18H_2O$ and 8.0 pounds per ton "O" ® sodium silicate. A pyrite scavenger float was made with a xanthate collector (0.1 pounds per ton) and Dowfroth 250 (0.1 pounds per ton).

The tailings from the pyrite scavenger flotation were then beneficiated to recover tin as follows. The tailings, thickened to about 25% solids, were placed in a Wemco conditioner operated at 2400 r.p.m. Sulfuric acid was added to reduce pH to 5.5. The pulp was conditioned for 5½ minutes with a collector emulsion prepared by high shear agitation of equal weight proportions of Procol CA540 (a sulfosuccinamate reagent manufactured by Allied Colloids, Inc.) and Eureka (mineral oil) in 99 parts by weight water. The emulsion was used in amount corresponding to 0.5 pounds per ton each of Eureka and CA540. The temperature of the pulp increased by 12° F. during conditioning.

The conditioned pulp at 20% solids was subjected to rougher tin flotation in a 500 gram Denver cell operated at 1500 r.p.m. The rougher concentrate was diluted to 10% solids and conditioned for one minute with a small amount of Procol CA540. The froth was cleaned twice by reflotation without further addition of reagents. The grade of tin recleaner concentrate was 11.9% Sn and it was obtained at a recovery of 45.3% Sn from the sulfide tailings.

When the test was repeated without emulsifying the sulfosuccinamate collector, the tin recleaner concentrate had about the same grade but recovery was reduced for this particular ore, thus confirming the value of using the emulsified reagent. (The use of a sulfosuccinamate alone in conjunction with the hydrosol is not excluded for other ore types.) However, when fuel oil was substituted for the mineral oil in the emulsion, tin grade and recovery were reduced significantly.

In other tests flotation was carried out using the emulsified sulfosuccinamate-mineral oil collector reagent and hydrosol dispersant at flotation pH values appreciably below 4 and above 7. The results were inferior to those obtained at pH values in the range of 4 to 7.

I claim:

1. A process for concentrating cassiterite from a slime-containing ore pulp which comprises conditioning said ore pulp with a collector reagent comprising a water-dispersible N-alkyl sulfosuccinamate in which the alkyl group contains from 12 to 22 carbon atoms and a gangue depressant comprising a hydrosol formed by mixing a salt of a metal with sodium silicate in the presence of water and, without desliming said pulp, subjecting it to froth flotation at a pH in the range of 4 to 7.

2. The process of claim 1 wherein flotation is carried out at a pH below 5.

3. The process of claim 1 wherein said gangue includes silica, silicates and other minerals.

4. A process for concentrating cassiterite from a slimed ore pulp without desliming said pulp which comprises treating said pulp with an alum sodium silicate hydrosol, adjusting pH to a value in the range of 4 to 7, conditioning said pulp, using high energy agitation, with a dilute aqueous emulsion containing mineral oil and an N-alkyl sulfosuccinamate in which the alkyl group contains 12 to 22 carbon atoms and subjecting the pulp, without removing slimes, to froth flotation at a pH in the range of 4 to 7.

5. A process for concentrating cassiterite from a slime-containing ore pulp which comprises conditioning said ore pulp with (a) a collector reagent comprising a water-dispersible N-alkyl sulfosuccinamate emulsified in water with a neutral petroleum hydrocarbon, the alkyl group in said sulfosuccinamate containing from 12 to 22 carbon atoms, and (b) a gangue depressant comprising a hydrosol formed by mixing a salt of a metal with sodium silicate in the presence of water, and, without desliming said pulp, subjecting it to froth flotation at a pH in the range of 4 to 7.

6. The process of claim 5 wherein said neutral oil is mineral oil.

7. the process of claim 5 wherein said sulfosuccinamate is N-octadecyl tetrasodium dicarboxyethyl succinamate.

8. The process of claim 5 wherein said salt is aluminum sulfate.

9. The process of claim 5 wherein the pulp is conditioned with sufficient agitation to cause an increase in temperature.

10. The process of claim 5 in which said ore pulp contains sulfide minerals that are removed by flotation with conventional sulfide collectors before conditioning said pulp with said emulsified collector reagent.

11. The process of claim 5 in which said ore pulp is conditioned with said hydrosol (b) before being conditioned with said emulsified collector agent (a).

* * * * *